United States Patent [19]

Lucassen et al.

[11] Patent Number: 5,001,814

[45] Date of Patent: Mar. 26, 1991

[54] APPARATUS FOR OPENING FIBER BALES OF SPINNING MATERIAL

[75] Inventors: Guenter Lucassen, Haltern; Reinhard Schmidt, Gescher, both of Fed. Rep. of Germany

[73] Assignee: Hergeth Hollingsworth GmbH, Dulmen, Fed. Rep. of Germany

[21] Appl. No.: 323,581

[22] Filed: Mar. 14, 1989

[30] Foreign Application Priority Data

Mar. 31, 1988 [DE] Fed. Rep. of Germany ..... 3811065

[51] Int. Cl.[5] ..... D01G 7/00

[52] U.S. Cl. ..... 19/80 R; 19/81

[58] Field of Search ..... 19/80 R, 81, 97, 97.5, 19/82, 85

[56] References Cited

U.S. PATENT DOCUMENTS 4,357,737 11/1982 Marx ..... 19/80 R
4,623,099 11/1986 Vosbein et al. ..... 19/80 R
4,756,059 7/1988 Temburg ..... 19/80 R
4,780,933 11/1988 Pinto et al. ..... 19/80 R

FOREIGN PATENT DOCUMENTS 2819292 11/1979 Fed. Rep. of Germany .
821548 4/1981 U.S.S.R. .
437242 10/1935 United Kingdom .

*Primary Examiner*—Werner H. Schroeder
*Assistant Examiner*—Michael A. Neas
*Attorney, Agent, or Firm*—Bailey & Hardaway

[57] ABSTRACT

Opening and blending apparatus for removing fiber from a row of bales has spaced parallel drums carrying disks and the like illustrated in spaced overlapping relation and being driven in opposite directions at different speeds. Spaced grid bar members may be offset in a gap between the drums and terminate in free ends. The grid rods may extend continuously from lateral fixation bars and may be connected by central elements.

6 Claims, 1 Drawing Sheet

APPARATUS FOR OPENING FIBER BALES OF SPINNING MATERIAL

BACKGROUND OF THE INVENTION

This invention relates to apparatus for opening and blending fiber from bales such as illustrated in U.S. Pat. Nos. 4,514,881, 4,595,149, 4,623,099, 4,715,722, 4,771,513, 4,774,758 and 4,780,933. Objects of the invention include increased opening or greater unentangling of the fibers with improved transport thereof in a suction channel.

The invention relates to an apparatus for opening fiber bales of spinning material, e.g. cotton, comprising two reducing means, e.g. milling rollers, disposed in mutually parallel relationship in a housing, the reduction of a bale or a row of bales being performed from the top. Between the milling disks of the rollers, there are provided grate rods which adjoin the bale surface and by which the reduction of the fiber material of the bales is supported. Above the gap formed by the reducing means, a suction channel provided for the removed fiber material may extend lengthwise of the reducing means.

There have been known various designs of opening devices of the foregoing type. In view of the rapidly rotating milling rollers used as a reducing means, it is often impossible to inhibit the entrainment of fiber clusters opened insufficiently so that the suction means not only receives disintegrated fibers but also a higher or lesser amount of fiber clusters.

SUMMARY OF THE INVENTION

It is an object of the invention to provide an opening means of the type specified above by which the opening operation is improved, intensified and more accurately performable in the sense of a fiber disintegration or unentanglement. The invention is characterized in that the reducing means, such as milling rollers are rotating at different speeds.

Due to the fact that the speed or peripheral speed of one milling roller is higher or lower than that of another cooperating therewith, the opening operation may be substantially improved. As a result of the relative movement between the teeth, combs etc. of the milling disks of the rollers, the larger fiber flocks are drawn apart, and the fiber lumps are additionally disintegrated. Due to the higher peripheral speed of the more rapidly rotating milling roller, the coherent fiber clusters are drawn apart and disintegrated. Now as before, an entrainment of the fibers is kept within limits by the grate.

According to another feature of the invention, the milling disks, seen from the front, may be arranged to overlap. Due to such an overlapping position of the milling disks of the milling rollers rotating in opposite senses or directions, the disintegration of the fiber during the reduction of the bales is additionally improved. Further, the opened fibers are more safely or satisfactorily thrown towards the vertical between the milling rollers. Thus, a more concentrated transport of the disintegrated fibers to the suction channel or suction funnel is insured. An improved disintegration effect and output concerning the fiber material removed from the bales is accomplished. The opening of the flocks is substantially intensified.

With regard to the milling means, the grate is of a design in which the grate rods being mutually offset between the milling disks, terminate in free ends. In special cases, the grate rods may continuously extend from one side to the other, and may be connected by central elements extending obliquely or being offset relative to the longitudinal axis of the milling roller.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
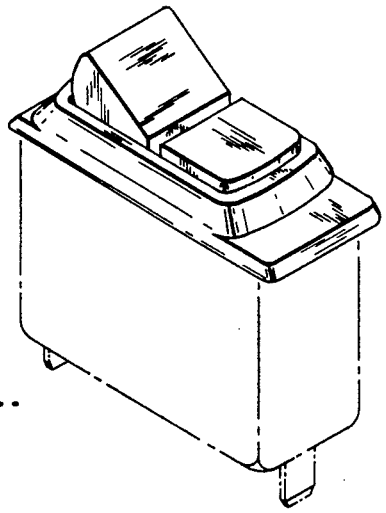
FIG. 1 shows a schematic end view of an apparatus for opening fiber bales according to the invention.
Figure 2:
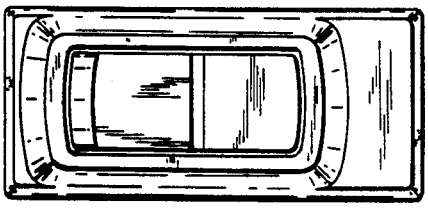
FIG. 2 shows a schematic plan view of the reducing means or reducing elements according to line II—II of FIG. 1.

The opening means 1 of FIG. 1 for removing fibers from a bale row 2 comprises a housing 3 for a reducing means consisting of milling rollers 4 and 5 which are disposed rotatably in longitudinal direction of housing 3, the milling rollers 4, 5 including support bodies 6 and 7 of a tubular design for a number of milling disks 8 and 9. The sense or direction of rotation of milling rollers 4, 8; 5, 9 is opposite, as indicated by the arrows, and the rollers are accommodated in an internal housing 11 which, in the center plane of the milling rollers 4 and 5, forms a channel 12 in which a suction air current is effective. Milling disks 8 and 9 are mutually offset in axial direction of the milling rollers. Beneath the latter, the grate rods 14 and 15 being also offset mutually accordingly are fixed to stationary bars 16 and 17 and are adjustable in height.

In the central longitudinal plane, the sense of rotation of the two milling rollers 4 and 5 is directed upwardly and in the same direction. During the reciprocation of housing 3 with the reducing means back and forth along the bale row 2, the fiber material removed from the bales is thrown upwardly and discharged through channel 12 by the suction current. The speeds of the milling rollers 4 and 5 may differ from each other. Each milling roller may be provided with a motor 20 and 21 driving by the transmission members 22 and 23 the appertaining milling roller. Subject to the prevailing demand, the speed of one milling roller may be higher or lower than that of the other. A resultant relative movement between the teeth of milling disks 8 and 9 involves an additional possible disintegration of fiber flocks or clusters which, by the milling disks are conveyed towards the suction channel 12. It is also possible to provide one sole drive only by which, with a corresponding gear, a different speed is imparted to each milling roller 4 and 5.

Figure 3:
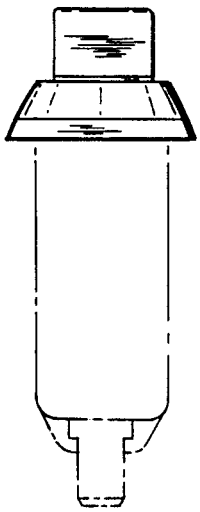
FIG. 3 illustrates a schematic end view of another embodiment of the opening means of the invention.
Figure 1:
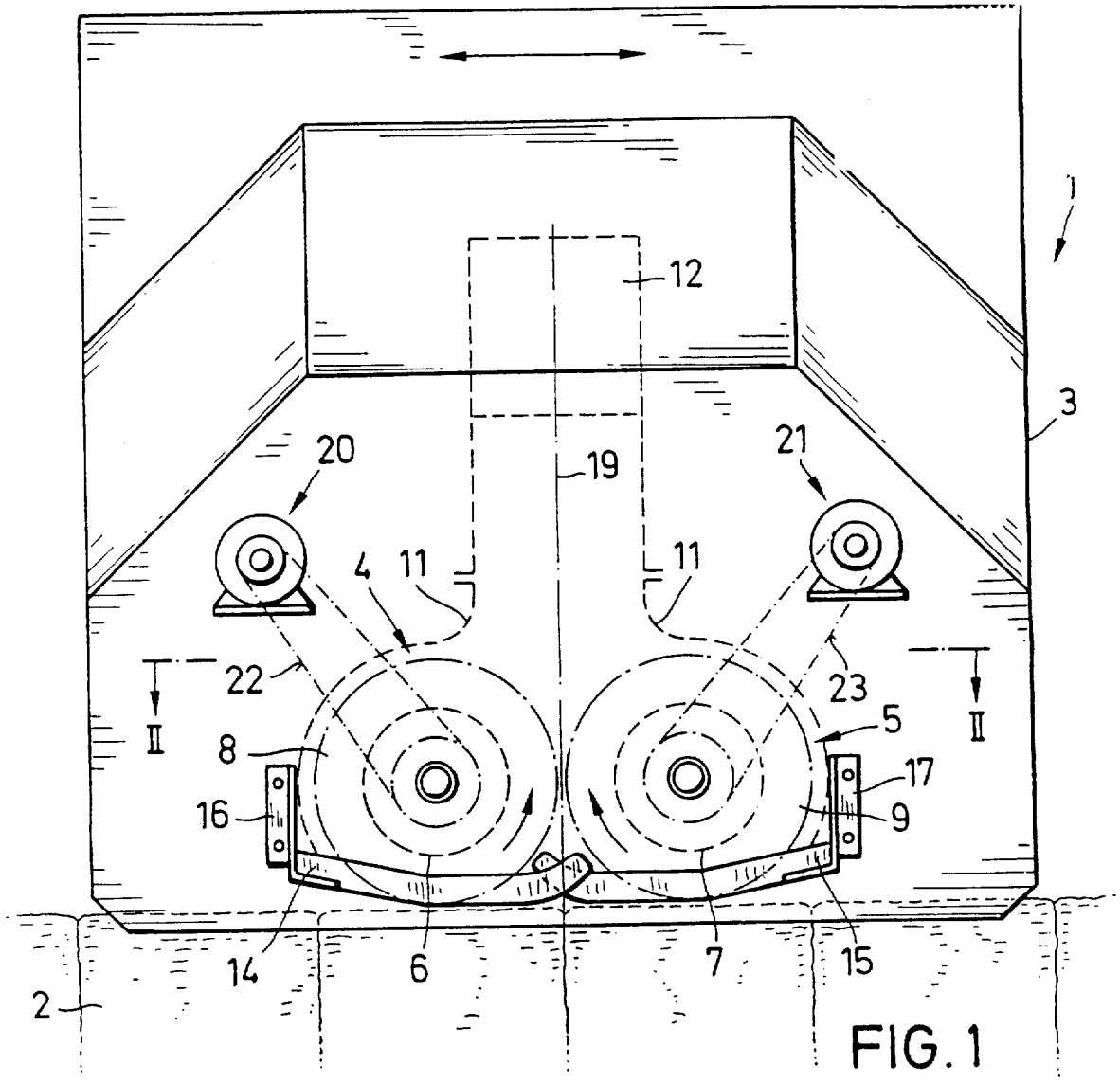
Figure 2:
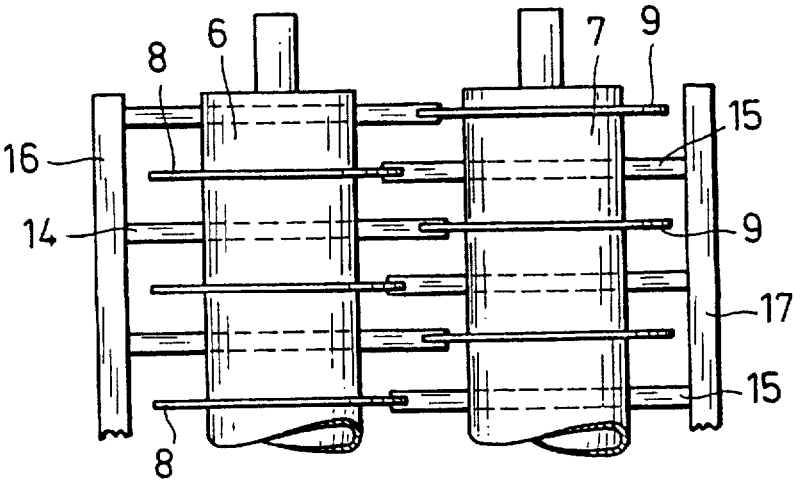
Figure 3:
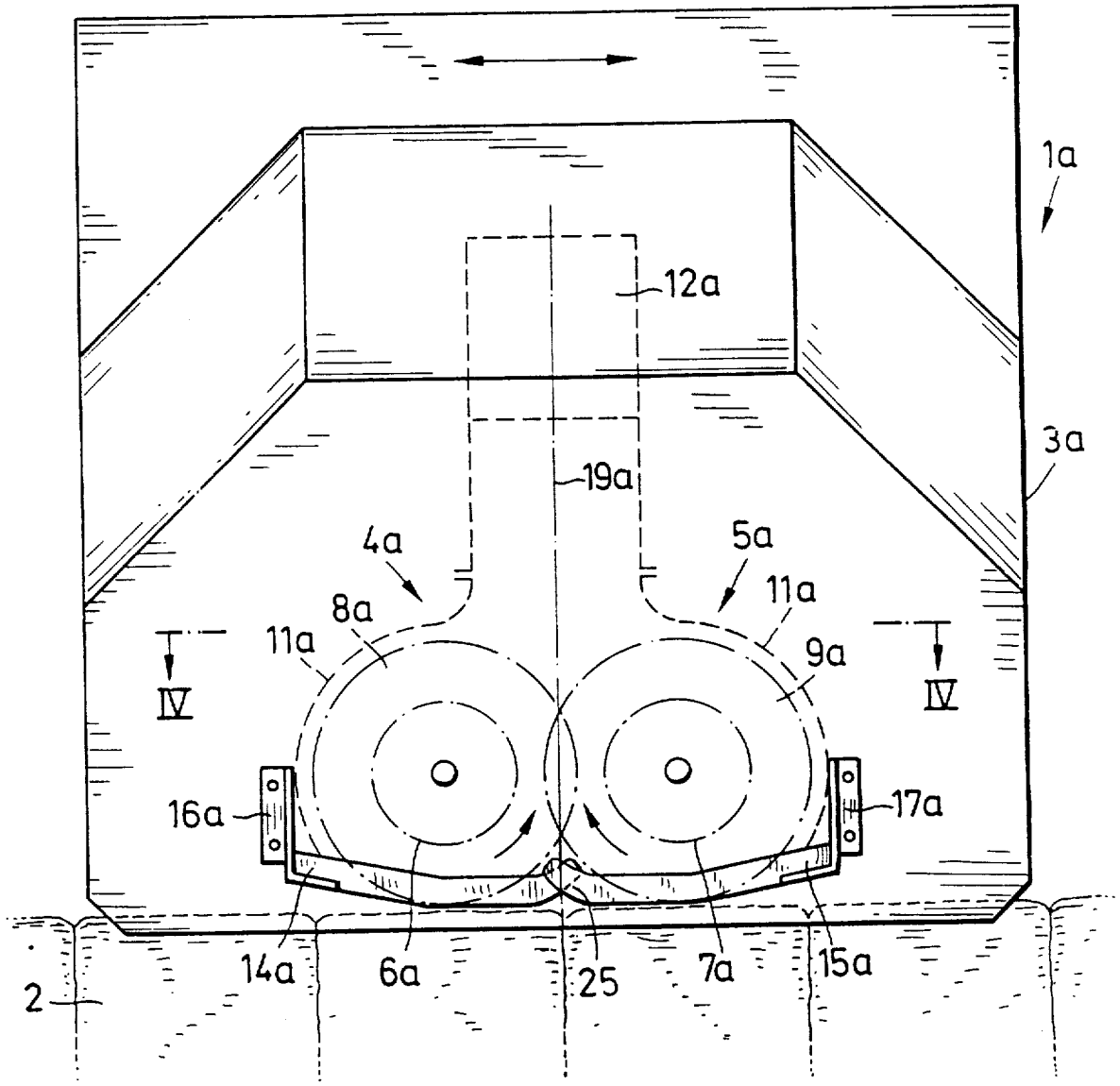
Figure 4:
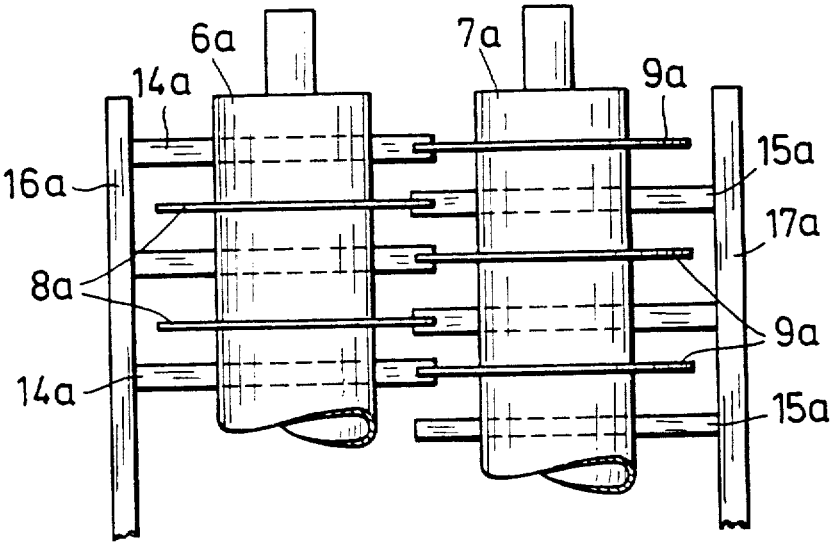
Figure 5:
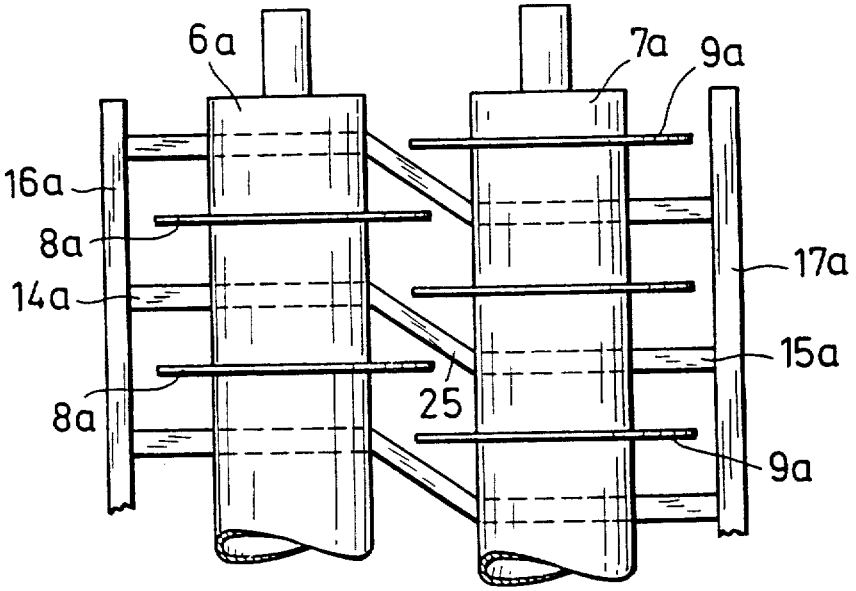

A modified form of the invention is illustrated in the embodiment of the opening device 1*a* of FIG. 3 whose reference numerals are marked with the additional notation a substantially corresponds to that of FIG. 1, the salient difference residing in the fact that the diameters of the milling disks of the milling rollers 4*a* and 5*a* are dimensioned such as to cause an overlapping or coinciding, with respect to the central plane 19*a* of the milling disks mutually offset in longitudinal direction of the milling rollers, the free space between the milling disks being decreased. As a result thereof, the fiber material removed from the bales is opened still more safely and reliably. Moreover, the fibers may be thrown more effectively in vertical direction to the suction channel 12*a*, it being possible for the milling rollers 4*a*, 5*a* to be driven oppositely at the same speed. The disintegrating effect is still intensified if, in accordance with the embodiment 1 of FIG. 1, the milling rollers 4*a*, 5*a* are driven in opposite senses at various speeds, such as explained in connection with the former embodiment.

Figure 5:
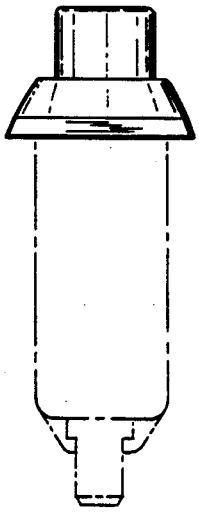
FIG. 5 is a schematic, modified embodiment of the grate in connection with the opening means of FIG. 3.
Figure 4:
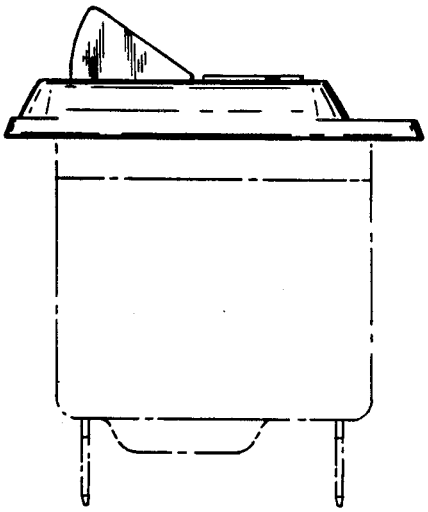
FIG. 4 shows a schematic detail of a plan view of the reducing elements according to line IV—IV of FIG. 3.

As obvious from FIG. 5, the grate rods terminating in a free end in case of the embodiment of FIG. 4, and, in accordance with the offset milling disks, being also offset in the direction of the longitudinal axis of the appertaining milling disks, may be interconnected by a central element 25 so that from one bar 16*a* to the other disposed oppositely, the grate rod extends continuously in forming one piece.

While a preferred embodiment of the invention has been described using specific terms, such description is for illustrative purposes only, and it is to be understood that changes and variations may be made without departing from the spirit or scope of the following claims.

What is claimed is:

1. Apparatus for opening fiber bales of spinning material such as cotton, comprising:

a pair of reducing milling rollers including milling disks, disposed in mutually parallel relationship in a housing and rotating in opposite directions;

grate rods being arranged between said milling disks of the milling rollers;

a gap formed by the reducing rollers;

a suction channel above said gap provided for the removed fiber material; and means rotating said milling rollers at different speeds.

2. Apparatus for opening fiber bales of spinning material such as cotton, comprising:

a pair of reducing milling rollers disposed in mutually parallel relationship in a housing;

wherein each milling roller of said pair of milling rollers rotates in a direction opposite that of the other and at a different speed;

grate rods being arranged between said milling disks of the milling rollers;

a gap formed by said reducing rollers;

a suction channel above said gap provided for the removed fiber material;

wherein said milling disks of the milling rollers overlap.

3. The structure set forth in claim 2, wherein said grate rods are mutually offset between said milling disks of the milling rollers and wherein said grate rods terminate in free ends.

4. The structure set forth in claim 2, wherein said grate rods interconnect by central elements.

5. Apparatus for opening fiber bales comprising:

spaced parallel rollers;

spaced opening means carried by said rollers;

means mounting said rollers for rotation in opposite directions;

grate rods carried in spaced relationship between said spaced opening means;

a suction channel for removal of fiber material removed from the bales by said opening means; and means driving said rollers in opposite directions and at different speeds.

6. Apparatus for opening fiber bales comprising:

spaced parallel rollers;

spaced opening means carried by said rollers;

means driving said rollers for rotation at different speeds;

grate rods carried in spaced relationship between said spaced opening means;

a suction channel for removal of fiber material removed from the bales by said opening means; and said opening means being carried in spaced overlapping relation on said rollers.

* * * * *

UNITED STATES PATENT AND TRADEMARK OFFICE

CERTIFICATE OF CORRECTION

PATENT NO. :5,001,814

DATED :Mar 26, 1991

INVENTOR(S) :Guenter Lucassen et al

It is certified that error appears in the above-identified patent and that said Letters Patent is hereby corrected as shown below:

The title page should be deleted to appear as per attached title page.

Figures 1-5 should be deleted to be replaced with figures 1-5 as shown on attached sheet.

Signed and Sealed this

Twenty-ninth Day of September, 1992

*Attest:*

DOUGLAS B. COMER

*Attesting Officer*

*Acting Commissioner of Patents and Trademarks*

United States Patent [19]

Lucassen et al.

[11] Patent Number: 5,001,814

[45] Date of Patent: Mar. 26, 1991

[54] APPARATUS FOR OPENING FIBER BALES OF SPINNING MATERIAL

[75] Inventors: Guenter Lucassen, Haltern; Reinhard Schmidt, Gescher, both of Fed. Rep. of Germany

[73] Assignee: Hergeth Hollingsworth GmbH, Dulmen, Fed. Rep. of Germany

[21] Appl. No.: 323,581

[22] Filed: Mar. 14, 1989

[30] Foreign Application Priority Data

Mar. 31, 1988 [DE] Fed. Rep. of Germany ..... 3811065

[51] Int. Cl.[5] ..... D01G 7/00

[52] U.S. Cl. ..... 19/80 R; 19/81

[58] Field of Search ..... 19/80 R, 81, 97, 97.5, 19/82, 85

[56] References Cited

U.S. PATENT DOCUMENTS 4,357,737 11/1982 Marx ..... 19/80 R
4,623,099 11/1986 Vosbein et al. ..... 19/80 R
4,756,059 7/1988 Temburg ..... 19/80 R
4,780,933 11/1988 Pinto et al. ..... 19/80 R

FOREIGN PATENT DOCUMENTS 2819292 11/1979 Fed. Rep. of Germany .
821548 4/1981 U.S.S.R. .
437242 10/1935 United Kingdom .

*Primary Examiner*—Werner H. Schroeder
*Assistant Examiner*—Michael A. Neas
*Attorney, Agent, or Firm*—Bailey & Hardaway

[57] ABSTRACT

Opening and blending apparatus for removing fiber from a row of bales has spaced parallel drums carrying disks and the like illustrated in spaced overlapping relation and being driven in opposite directions at different speeds. Spaced grid bar members may be offset in a gap between the drums and terminate in free ends. The grid rods may extend continuously from lateral fixation bars and may be connected by central elements.

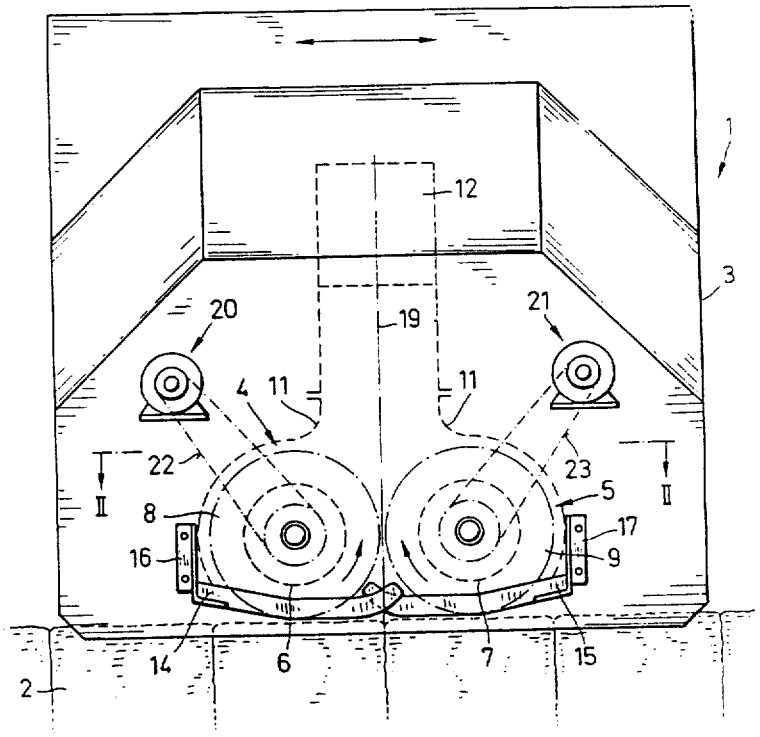

6 Claims, 1 Drawing Sheet